US005456622A

United States Patent [19]

Breivik et al.

[11] Patent Number: 5,456,622

[45] Date of Patent: Oct. 10, 1995

[54] METHOD AND SYSTEM FOR CONNECTING A LOADING BUOY TO A FLOATING VESSEL

[75] Inventors: Kare Breivik, Tau; Harald Kleppesto, Bryne; Arne Smedal, Farvik, all of Norway

[73] Assignee: Den Norske Stats Oleselskap A.S., Stavanger, Norway

[21] Appl. No.: 244,441

[22] PCT Filed: Mar. 30, 1992

[86] PCT No.: PCT/NO92/00053

§ 371 Date: Aug. 8, 1994

§ 102(e) Date: Aug. 8, 1994

[87] PCT Pub. No.: WO93/11030

PCT Pub. Date: Jun. 10, 1993

[30] Foreign Application Priority Data

Nov. 27, 1991 [NO] Norway ..... 914652

[51] Int. Cl.[6] ..... B63B 22/02

[52] U.S. Cl. ..... 441/3; 441/5

[58] Field of Search ..... 114/230; 441/3–5

[56] References Cited

U.S. PATENT DOCUMENTS

| | | | |
|---|---|---|---|
| 4,086,865 | 2/1978 | Statham | 114/230 |
| 4,490,121 | 12/1984 | Coppens et al. | 114/230 |
| 4,650,431 | 3/1987 | Kentosh | 441/5 |
| 5,044,297 | 9/1991 | dee Baan et al. | 441/4 X |
| 5,316,509 | 5/1994 | Boatman et al. | 441/3 |

OTHER PUBLICATIONS

Design, Construction, Installation and Operation of a Disconnectable Mooring System for an FPSO in the South China Sea, by C. Davidson, Single Buoy Moorings Inc., as presented at the 6th International Conference on Floating Production Systems, 10th/11th Dec. 1990.

Marginal Offshore Fields Tanker Loading and Storage Systems, MHL GEC Mechanical Handling Limited.

*Primary Examiner*—Sherman Basinger

*Attorney, Agent, or Firm*—Jon Carl Gealow; Keck, Mahin & Cate

[57] ABSTRACT

A method and a system for connecting a submerged loading/unloading buoy to a submerged receiving space in a floating vessel for transfer of oil to or from the vessel. The buoy is anchored to the sea bed and is connected to a transfer line for carrying the oil. A sink line, having an auxiliary buoy attached to its end, is lowered from the vessel through the receiving space, with the auxiliary buoy coming to the water surface. A suitably marked pick-up line connected to the loading/unloading buoy, is taken up and connected to the sink line. The vessel is then positioned above the submerged loading/unloading buoy and the sink and pick-up lines are pulled up through the receiving space, so that the loading/unloading buoy is hoisted up and moved to a locking position in the receiving space. The vessel is provided with a hoist to lift the lines and the loading/unloading buoy, and also with a service shaft connecting the receiving space to the deck of the vessel.

20 Claims, 8 Drawing Sheets

METHOD AND SYSTEM FOR CONNECTING A LOADING BUOY TO A FLOATING VESSEL

BACKGROUND OF THE INVENTION

I. Field of the Invention

The invention relates to a method for connecting a buoy to a floating vessel, for transfer of a flowable medium to or from the vessel, wherein the vessel is brought into position above a submerged loading/unloading buoy which is anchored to the sea bed and is connected to at least one transfer line for medium, and a hoisting means on the vessel is connected to the buoy whereafter it is hoisted up and inserted into a downwardly open submerged receiving space in the vessel.

Further, the invention relates to a system for connecting a buoy to a floating vessel, for transfer of a flowable medium to or from the vessel, comprising a submerged loading/unloading buoy which is anchored to the sea bed via catenary mooring lines and is connected to at least one transfer line for medium, a downwardly open submerged receiving space arranged on the vessel for receipt of the buoy, and a hoisting means arranged on the vessel for connection with and hoisting of the buoy, so that it is inserted into the receiving space.

II. Description of Related Art

A method and a system of the above-mentioned type are known from e.g. U.S. Pat. specification No. 4,604,961 (corresponds to Norwegian patent specification No. 167 906). This known system is based on a vessel having a through-going deck opening in a central region of the vessel, the lower part of the through opening forming the submerged receiving space for a mooring element in the form of a submerged buoy. In the receiving space there is arranged a rotating body (turret) which is rotatably mounted in the hull of the vessel and is designed for receipt and attachment of the mooring element, the latter to this end being provided with a hydraulically actuated locking mechanism for attachment to the rotating body. Further, the vessel is provided with a derrick for the lowering of a retrieval string having a retrieval connector at its lower end for interconnection with the mooring element, so that this may be pulled up and into the receiving space. The interconnection is obtained in that the mooring element is provided with a conical centering receptacle having a socket arranged at the bottom wherein the retrieval connector may be received and secured, e.g. by means of a bayonet lock. The lower end of the retrieval string preferably is provided with sonar and TV equipment to ensure positioning of the retrieval connector in the centering receptacle.

The known system is encumbered with some drawbacks which will be discussed below.

As mentioned, the vessel of the known system is based on a through-going deck opening, which reduces the strength of the vessel and poses demands for additional reinforcements in the bottom and the deck of the vessel. Experience has also shown that ships having a through-going deck opening are subject to fatigue in the hull.

Since the rotating body is attached to the vessel under water, this requires divers for inspection and minor maintenance. Major maintenance requires docking of the vessel. Because of the fact that the rotating body is mounted to the vessel, there arise large frictional forces which are to be overcome by torques from the mooring element. These torques are relatively large due to the large outer diameter of the rotating body, and this results in correspondingly large loads. Further, it may result in uncontrolled rotation of the system, so that it becomes necessary to use a braking system for retaining the rotating body. In case of rotation the braking system is then released and the rotating body is rotated in a controlled manner by means of active drive.

The known system has a small ability to absorb moments caused by the horizontal mooring forces, something which results in a substantial risk for jamming actions in the mounting arrangement.

The hydraulically actuated locking mechanism which is arranged on the mooring element requires divers for connection of the control hydraulics. Diver operations in connection with connection and disconnection render the use of the system as a transport system impossible, when using shuttle tankers. Further, there is a big risk for faulty operation and damages in case of uncontrolled disconnection. In case of breakage of the hydraulic system there is no possibility for the connection of a back-up or auxiliary device.

As mentioned, connection/disconnection takes place by means of a derrick-operated string having a special retrieval means. When connecting, this requires small relative movements between vessel and mooring element/buoy, so that the connection can be carried out in a safe manner only under relatively calm weather conditions. Also this circumstance makes the system unusable as a transport system with shuttle tankers. Further, the connecting as well as the disconnecting operation requires a relatively long time to be accomplished.

SUMMARY OF THE INVENTION

It is an object of the invention to provide a method and a system for connecting a loading/unloading buoy to a floating vessel, wherein connection can be carried out in a simple and quick manner, even in bad weather.

Another object is to provide a method and a system making it possible for the buoy to remain connected to the vessel in all weathers, a quick disconnection being able to be carried out if a weather limitation should be exceeded.

BRIEF DESCRIPTION OF THE DRAWINGS

The invention will be further described below in connection with exemplary embodiments with reference to the drawings, wherein.

DETAILED DESCRIPTION OF THE PREFERRED EMBODIMENT

Figure 1:
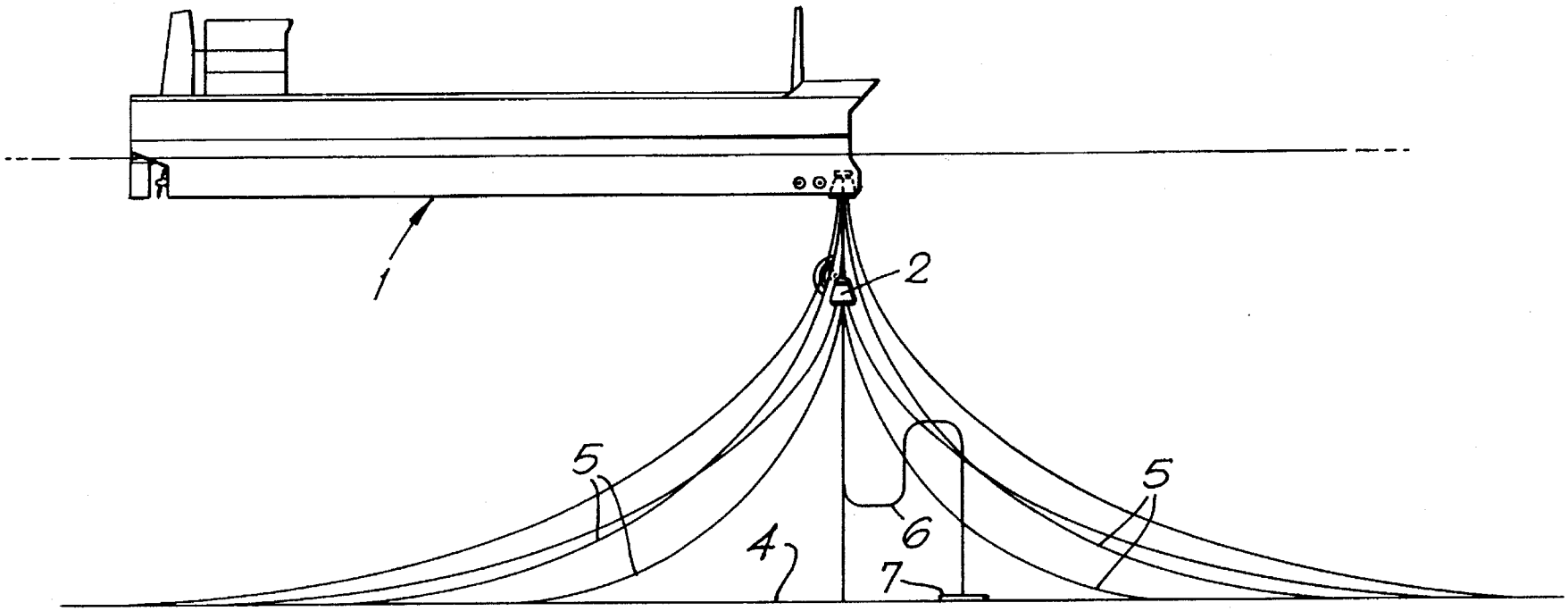
FIG. 1 shows a view of a vessel and an anchored buoy, wherein the buoy is shown in a submerged position of equilibrium as well as in a connected condition.

In the various drawing Figures corresponding members and elements are designated by the same reference numerals.

Before the method for buoy connection is described, there will first be given an outline of main elements in the system according to the invention.

As appears from FIGS. 1–4, the system includes a floating vessel 1 and a buoy 2 which are to be connected to the vessel in a submerged receiving space 3 arranged therein. The vessel is a tanker, for example a so-called shuttle tanker, and the buoy is a loading/unloading buoy for the transfer of a flowable medium to or from tanks (not shown) on board the vessel. Normally, the flowable medium will be hydrocarbons (oil or gas), but the expression "flowable medium" here must be construed in a wide sense, since it may also be the question of other flowable materials, also in powder or particle form.

As shown in FIG. 1, the buoy 2 is anchored to the sea bed 4 by means of a suitable number of mooring lines 5 extending as catenary lines between the buoy 2 and suitable anchoring points at the sea bed 4. Each of the mooring lines may consist only of a chain, especially at smaller water depths. Generally, however, it is convenient that each of the mooring lines consists of a chain (partly resting on the sea bed) combined with an upper wire, an elastic hawser or the like, with or without buoyancy buoys (not shown) which may e.g. be placed in the connecting point between the chain and the wire, so that, for the anchoring system, there is obtained a suitable stiffness/characteristic which is adapted to the vessel and water depth in question. Thereby it is achieved that the buoy can be executed in a standard design, independent of the water depth. When the buoy 2 floats in the sea in the lower position in FIG. 1, its buoyancy will be in equilibrium with the forces from the anchoring system, so that the buoy will float at a predetermined desired depth under the water surface, where it will not be damaged or represent any danger to seagoing Traffic. The weight of the buoy normally will be in the range of 30–50 tons.

The buoy 2 is coupled to a transfer line 6 in the form of a flexible riser which is shown to extend between the buoy and a station 7 suggested at the sea bed. This station for example may be an installation for the supply or storage of oil, but generally symbolizes a place communicating with the buoy 2 in order to deliver flowable medium to or receive flowable medium from the buoy. In connection with e.g. offshore oil and gas production, the station 7 normally will be located at the sea bed. However, in other applications, it may be located at another place, for example in sheltered waters or on land. In such a case the buoy possibly may be "anchored" only by means of the flexible transfer line. Possibly, more than one transfer line may be connected to the buoy. It is also conceivable that the transfer line, or several transfer lines, is/are connected to a "station" in the form of a corresponding submerged buoy.

As appears from FIGS. 1–4, the submerged receiving space 3 is shown to be arranged in the lower part of the bow of the vessel 1. This is expedient for several reasons. The receiving space then is arranged in a region which from before will be designed for absorbing large loads. Further, there is not interfered in the structure of the vessel with a through-going deck opening which will reduce the strength of the vessel. In addition, the placing is favourable for carrying out the connection method according to the invention.

The receiving space 3 is connected with the deck 8 of the vessel through an access or service shaft 9. Further, in the receiving space 3, there is arranged a shutter 10 for shutting off the service shaft 9 and the upper part of the receiving space from the sea when the receiving space is not in use, i.e. when it does not receive a buoy 2. Among other things, this gives a possibility for inspection of equipment fitted in the shaft and the upper part of the receiving space.

in the deck area of the vessel there is arranged a hoisting means in the form of e.g. a winch 11 having a suitable line which can be lowered through the shaft 9 and the receiving space 3 and connected with the buoy 2, so that this can be hoisted up and moved in place in the receiving space 3.

Figure 2A:
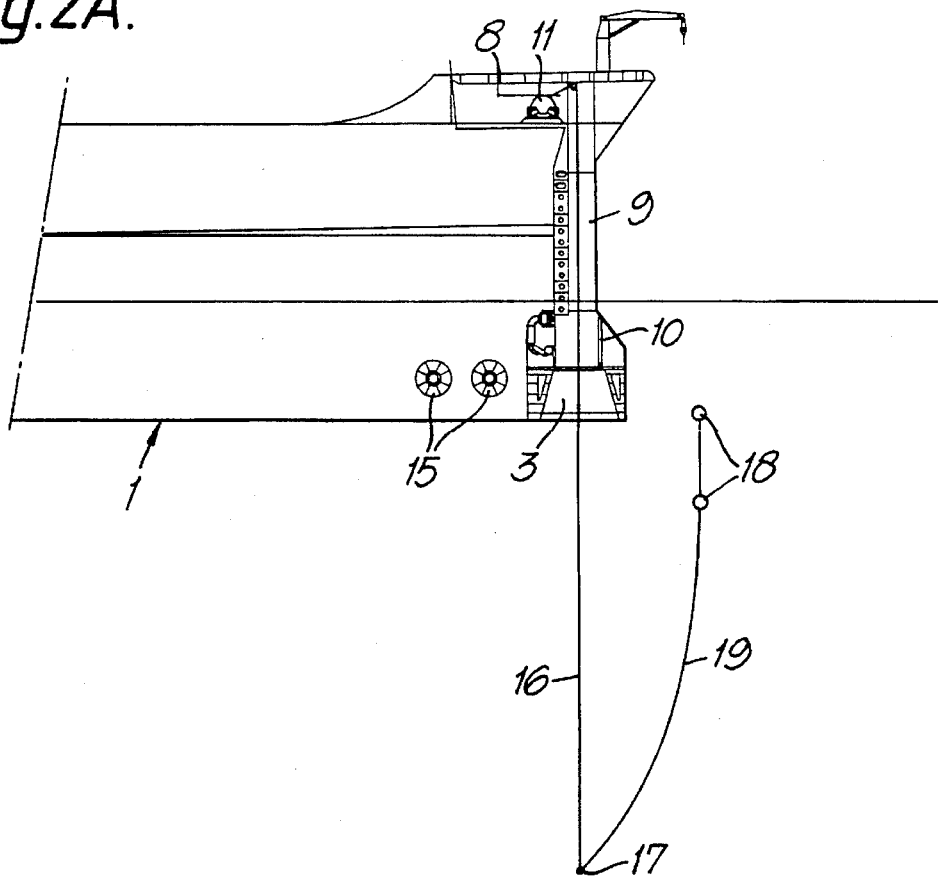
FIGS. 2A–2C illustrate initial stages when connecting a submerged buoy to a vessel in accordance with the method according to the invention.
Figure 2B:
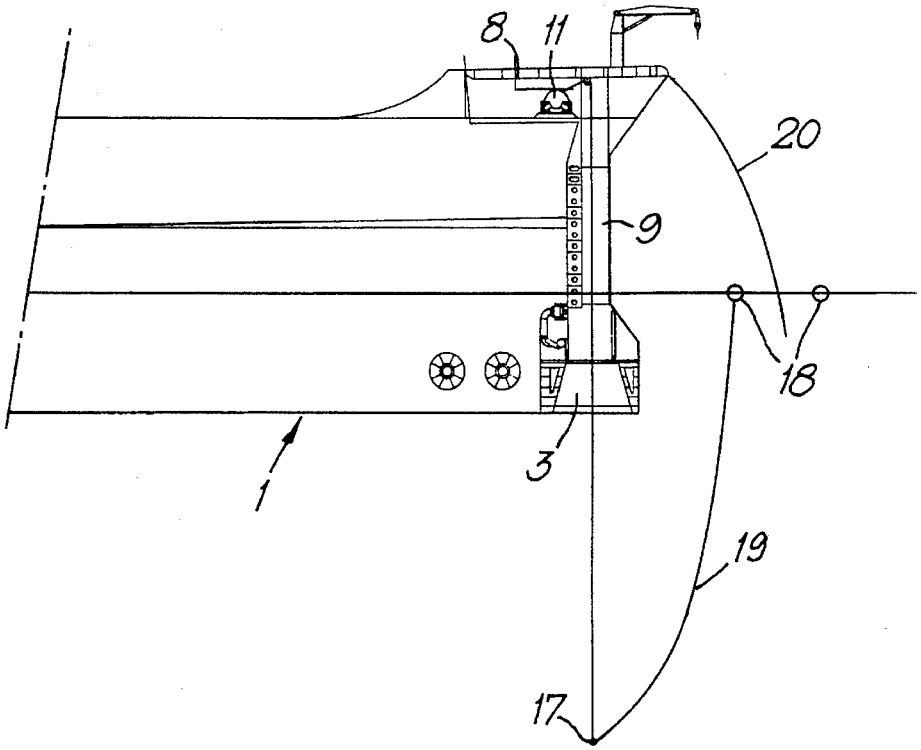
Figure 2C:
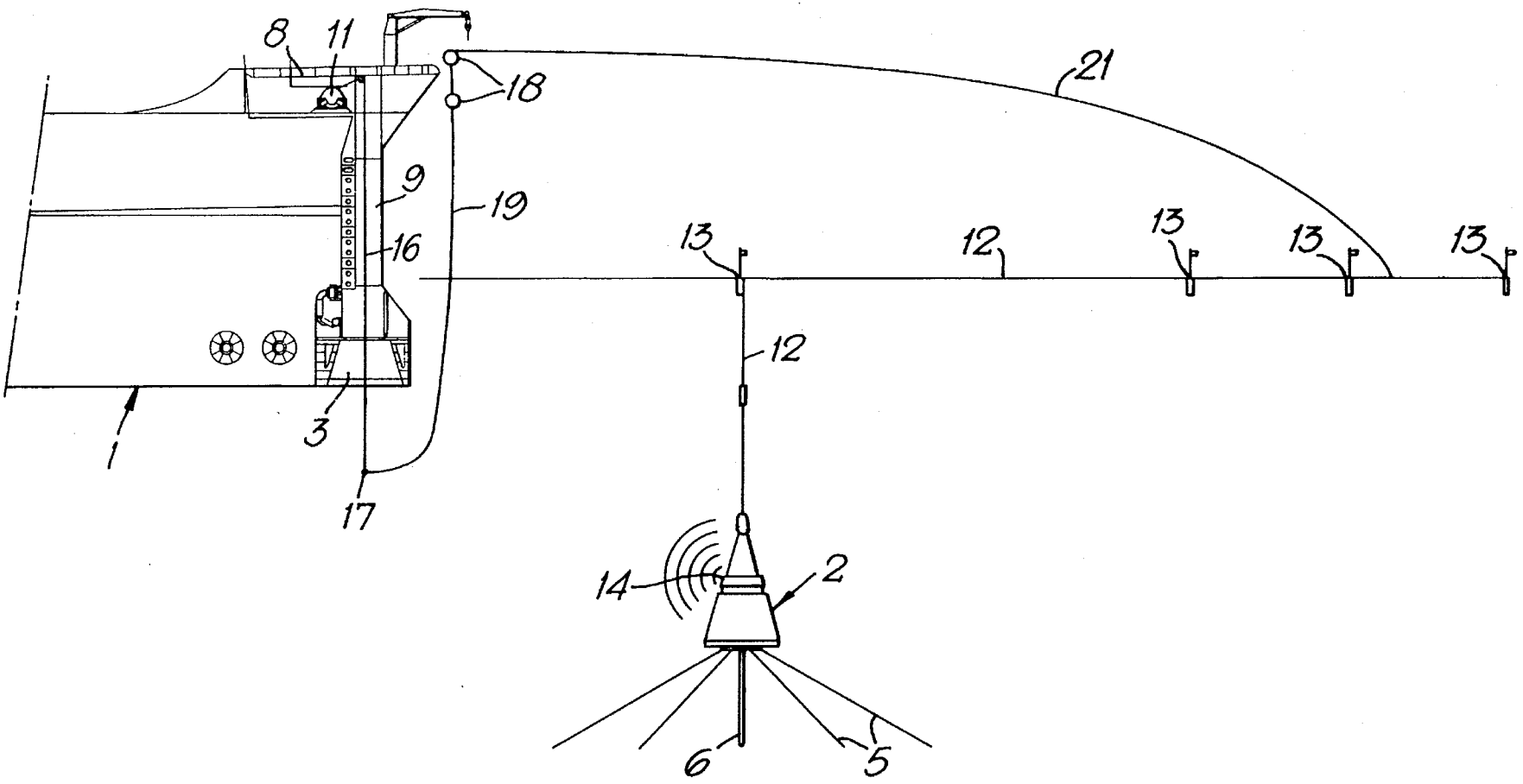

In order for a vessel to find the submerged buoy, this will be marked with a suitable marking means, e.g. a pick-up line 12 which is connected to the buoy and is marked by means of at least one marking means, e.g. a number of marking buoys 13 floating at the water surface, as shown in FIG. 2C. In addition, the buoy may be provided with a suitable signal transmitter 14, e.g. a transponder, which will respond to signals from a transceiver on the vessel.

The method for buoy connection according to the invention now will be further described with reference to FIGS. 1 and 2.

When a vessel 1, e.g. a shuttle tanker, approaches the loading berth where a submerged buoy 2 is anchored, it will approach the buoy downwind from one side of the marking buoys 13. To ensure a rapid and safe positioning, the vessel, in addition to the normal stern propeller, will be provided with a positioning arrangement which may include bow thrusters 15 in addition to a dynamic positioning system. When the vessel is in a suitable position, the shutter 10 in the receiving space 3 is opened, so that the water rises into the shaft 9. A sink line 16 having a weight 17 placed at the end thereafter is lowered by means of the winch 11 through the shaft 9 and the receiving space 3 into the sea, as shown in FIG. 2A. A pair of auxiliary buoys 18 are fastened at a distance from each other to an additional line 19 which is fastened to the end of the sink line 16. It will be clear that the sink line 16 and the additional line 19 possibly may be constituted by one and the same line, the weight or lead 17 being able to be fastened at a suitable distance from the end of the sink line, with the two auxiliary buoys 18 placed at the line end. The sink line is lowered so much that the auxiliary buoys come under the vessel, the vessel 1 during this operation going slowly astern, so that the auxiliary buoys keep clear of the vessel hull and float to the surface with suitable pulling-up of the sink line. The auxiliary buoys 18 and said lines 16 and 19 thereafter are catched from the vessel, for example by means of a catch line 20 having a hook (not shown) at the end, and are brought up onto the upper deck 8 of the vessel, as suggested in FIGS. 2B and 2C. The pick-up line 12 which is connected to the buoy 2 thereafter is taken up from the sea and transferred to the vessel 1 and connected with the sink line 16, whereafter these lines are let over board, the auxiliary buoys 18 and the additional line 19 preferably having been removed.

Figure 4:
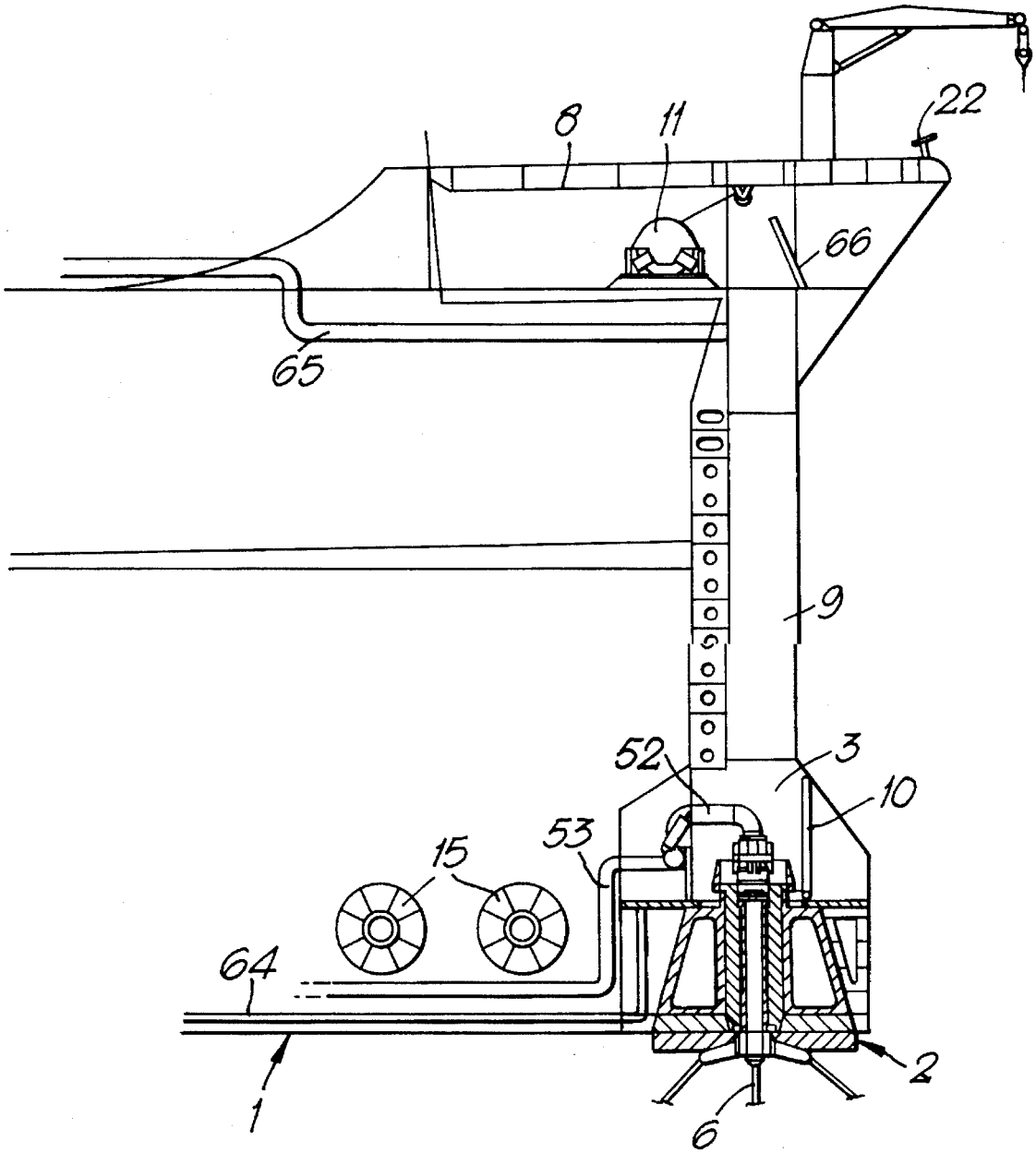
FIG. 4 shows a schematic side view of a part of a vessel designed in accordance with the system according to the invention.

If a tender vessel (not shown) is present, the pick-up line 12 may be taken up and transferred to the vessel 1 by means of the tender vessel, the pick-up line then normally being shot over to the vessel 1 by means of an airgun or the like. When a tender vessel is not present, the pick-up line 12 is taken up by means of a catch line 21 which is shot over the pick-up line 12 by means of an airgun or the like on the vessel 1, and thereafter is hauled on board the vessel together with the pick-up line. An airgun 22 for this purpose is shown in FIG. 4.

It is expedient that the pick-up line 12 is connected to the sink line 16 while the vessel is at a good distance from the buoy 2, and that the line is pulled up by means of the winch 11 until tightening is obtained, before the vessel 1 is moved into position above the submerged buoy. Thereby one avoids the risk for entanglement of lines, or that lines are pulled into the thruster tunnels when using the bow thrusters 15.

The vessel thereafter is moved into position above the submerged buoy under utilization of the positioning system of the vessel, and by means of possible signal communication between the vessel and the signal transmitter of the buoy. Thereafter the sink line 16 (which now functions as a pulling-up line) together with the pick-up line 12 are pulled up through the receiving space 3 and the shaft 9, so that the buoy 2 is hoisted up and moved to a locking position in the receiving space, and thereafter the buoy is locked in the receiving space in a manner which will be further described below.

Figure 3:
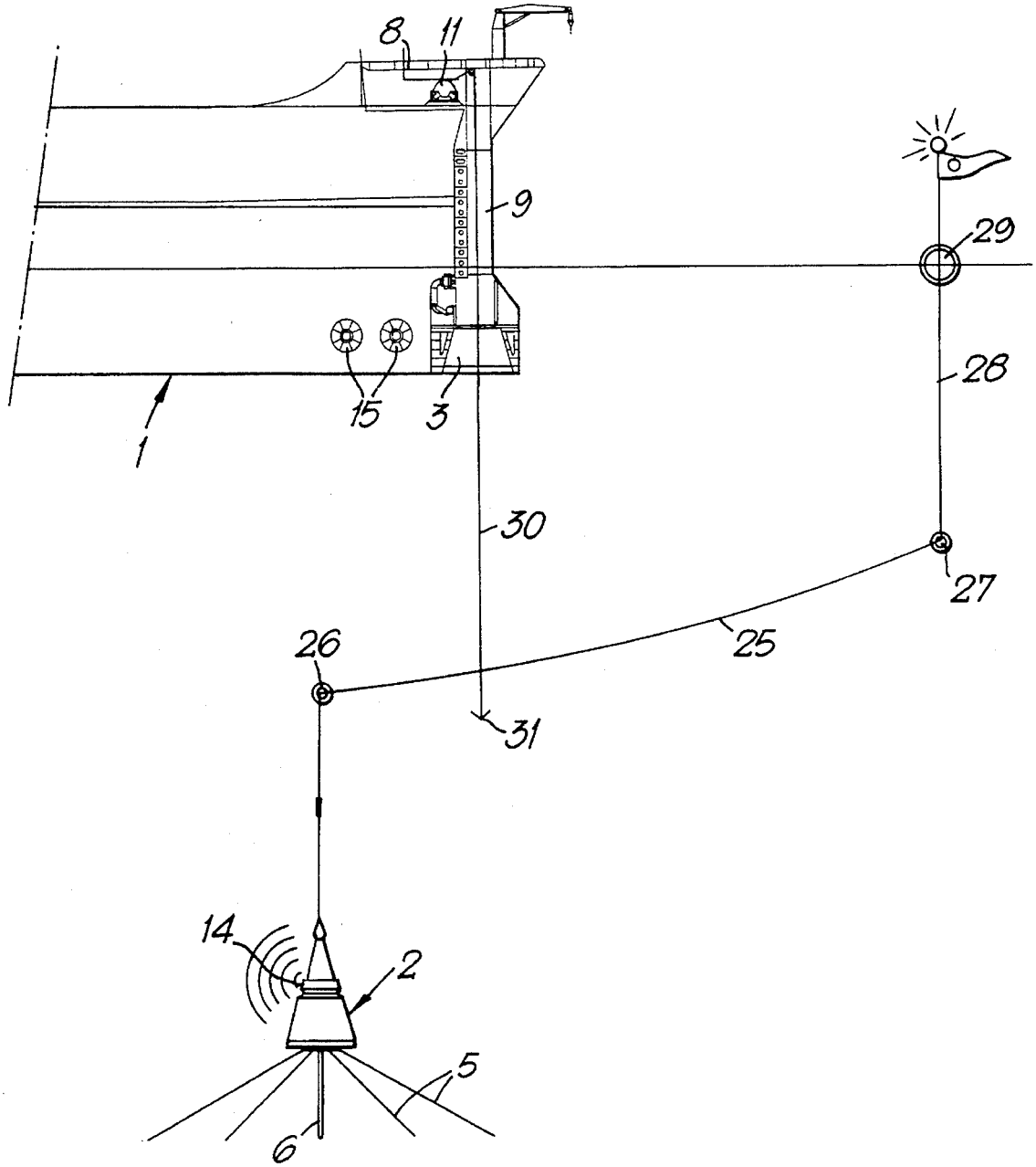
FIG. 3 illustrates a variant of the method.

Another variant of the method according to the invention is shown in FIG. 3. In this case the submerged buoy 2 is connected to a pick-up line 25 extending essentially horizontally over a certain distance in submerged condition in the sea, as shown as an example in FIG. 3. The pick-up line 25 here has an essentially horizontal extension between a floating body 26 above the buoy and a sink body 27 hanging in a line 28 under a marking buoy 29 floating in the water. The sink body 27 may e.g. be a drag anchor, and possibly several drag anchors may be arranged along the pick-up line 25 suspended in the water. In the Figure there is shown only one marker buoy 29, but it is clear that several marker buoys may be arranged, for example in a corresponding manner to That shown in FIG. 1. With such an arrangement there is obtained a somewhat simplified connecting procedure as compared to the method described above, since one may use a pure dragging-up technique for connection to the pick-up line of the buoy. Thus, when the vessel 1 has been moved to a suitable position in relation to the pick-up line 25, a sink line 30 having a catching means 31, e.g. a grapnel, attached to the end, is lowered through the shaft 9 and the receiving space 3 by means of the winch 11. The catching means 31 is lowered to a suitable depth relative to the pick-up line 25, and by suitable manoeuvring of the vessel the pick-up line 25 is catched by means of the catching means. The vessel 1 thereafter is moved into position above the buoy 2 with the use of the positioning system of the vessel, and by means of signals from the signal transmitter 14 of the buoy, and thereafter the lines are pulled up by means of the winch 11, and the buoy 2 is hoisted up and moved in place in the receiving space 3, and is locked therein in a manner corresponding to that described above, and as further described below.

In addition to the features mentioned above the present system includes a number of additional features which are advantageous and of importance in the method according to the invention, and which are to be described below.

Figure 5:
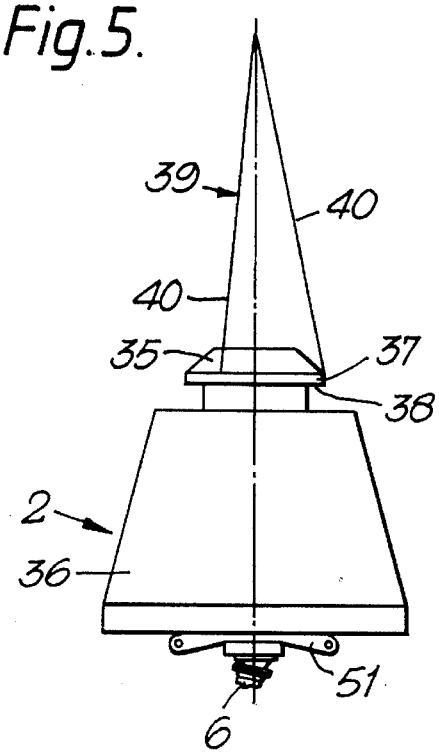
FIG. 5 shows a side view of a buoy in the system according to the invention.

As shown in FIG. 4, the buoy 2 and the lower part of the receiving space 3 have a matching conical shape to facilitate the introduction and placing of the buoy in the receiving space. An example of the external design of the buoy is schematically shown in FIG. 5. In the illustrated embodiment the buoy 2 consists of an upper and a lower cone member 35 and 36, respectively, and the upper cone member 35 comprises a collar 37 having a downwardly facing annular abutment edge 38 for engagement with locking elements forming part of the above-mentioned locking means for locking of The buoy in place in the receiving space. Further, the buoy is provided with a so-called lifting bridle 39 which is fastened to the upper member 35 of the buoy and consists of two or more lines 40 (in the illustrated case three lines, the two lines to the left in the Figure being coincident) forming a conical contour functioning as an upper continuation of the external cone shape of the buoy and causing the buoy in the initial lead-in phase to be inserted in a safe and correct manner in the receiving space 3 in the vessel.

Figure 6:
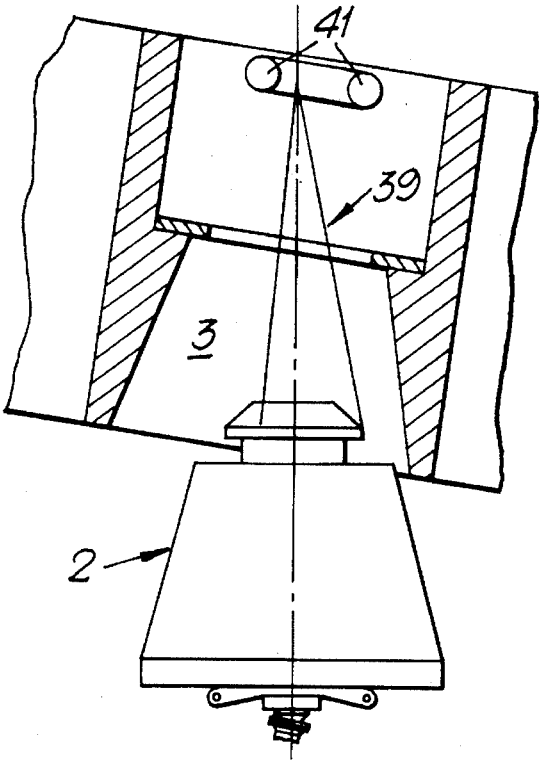
FIGS. 6 and 7 show side views of a buoy which is in the process of being pulled into a receiving space in a vessel.
Figure 7:
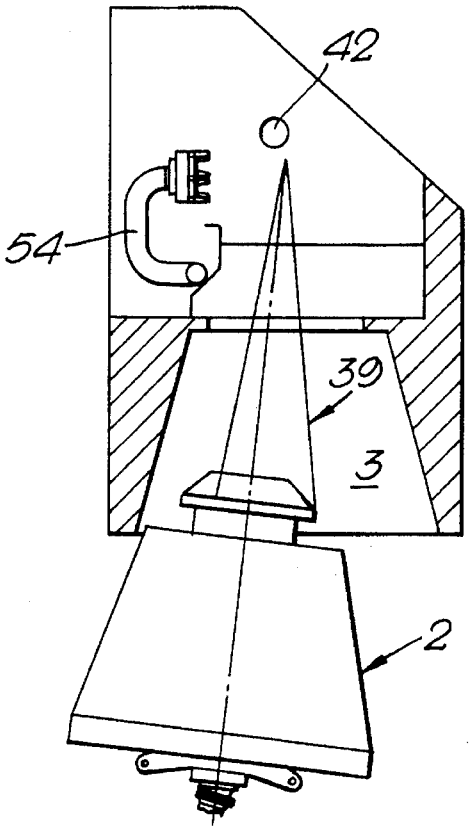

This initial lead-in phase is illustrated in FIGS. 6 and 7 which show schematic segments of the receiving space 3 with rolling movement of the vessel (FIG. 6) and with oblique introduction of the buoy 2 in the receiving space 3 (FIG. 7). For additional guiding of the buoy during the introduction, guide rollers for this purpose may be arranged in the upper part of the receiving space 3. Thus, a pair of guide rollers 41 are suggested in FIG. 6, whereas a guide roller 42, which is arranged at right angles to the rollers 41, is suggested in FIG. 7. The roller 42 may e.g. be mounted at the free end of the above-mentioned closing shutter 10 (FIG. 4), the shutter during the lead-in operation being able to be placed in a suitable position which may be changed according to requirement, in order to place the guide roller 42 in the desired guiding position.

Figure 8:
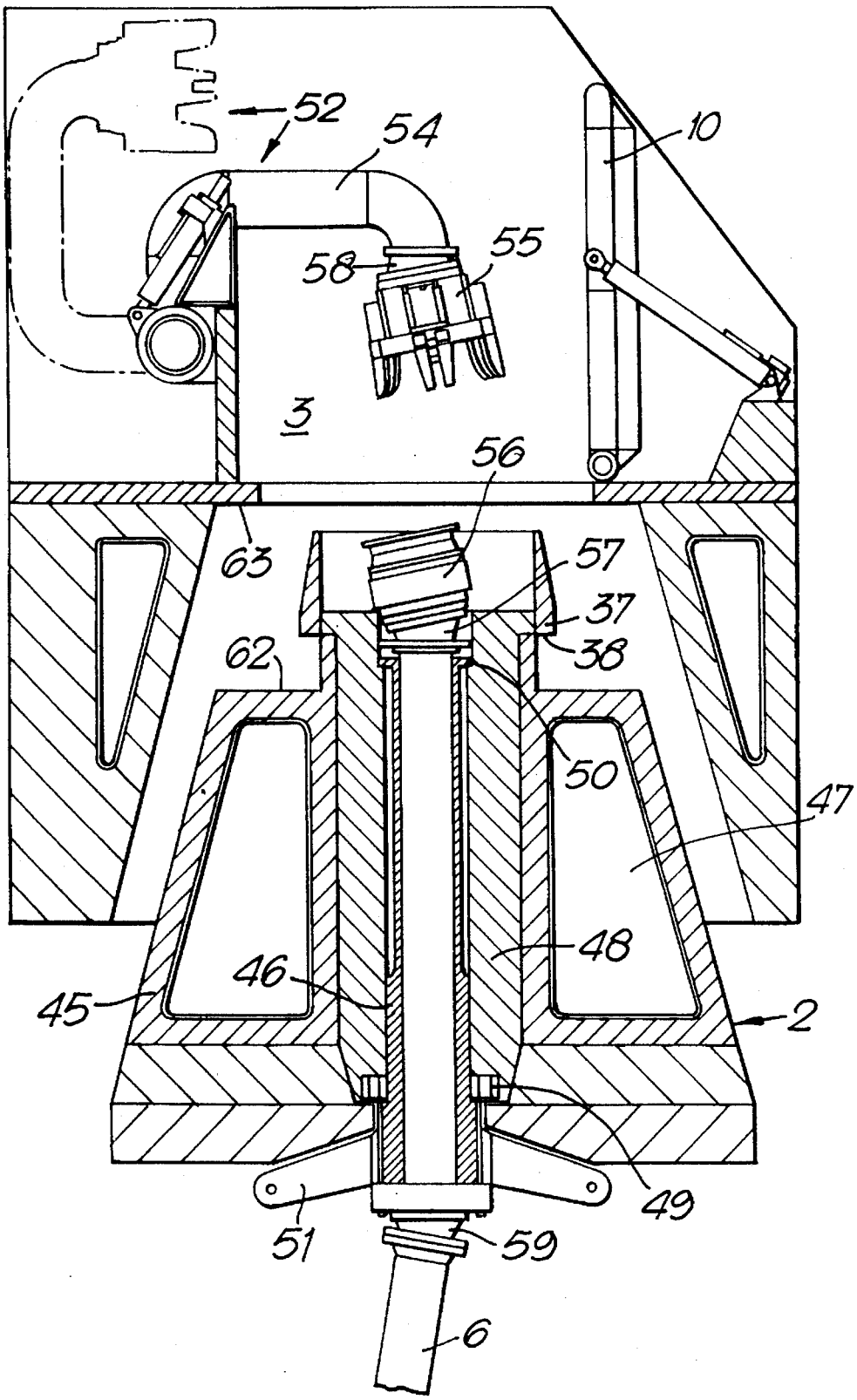
FIG. 8 shows a schematic sectional side view of an embodiment of a receiving space in a vessel and a buoy which is adapted to the receiving space.

The construction of the buoy 2 is shown more in detail in the longitudinal sectional view in FIG. 8. As shown, the buoy consists of an outer buoyancy member 45 and a central member 46 which is rotatably mounted in the outer member and has a through-going passage for medium to be transported via the buoy. When needed, the central member may comprise several such passages. The outer member 45 is divided into several water-tight buoyancy chambers 47, and further it comprises a central replaceable bearing support member 48 having a lower radial bearing 49 and an upper axial bearing 50 for the central member 46. The central member is provided with a lower reinforced portion 51 for attachment of the mooring lines of the buoy 2 (not depicted in FIG. 8).

In the upper part of the receiving space 3 there is arranged a coupling unit 52 which is associated with a tube system 53 (see FIG. 4) for medium transfer arranged on the vessel. The coupling unit comprises a coupling tube 54 which, by means of hydraulics, is pivotable between a stowed position and a connecting position (both positions shown in FIG. 8), one end of the tube being provided with a coupling head 55 for connection to the upper end of the central member 46 of the buoy when the buoy is in place in the receiving space. This connection takes place through a swivel means 56 which, in the illustrated embodiment, is coupled to the central member 46 through a ball joint 57. Also the coupling head 55 comprises a ball joint 58. The illustrated embodiment also includes a third ball joint 59 arranged between the lower end of the central member and the transfer line 6 of the buoy. The ball joints 57 and 58 especially are arranged for accommodating dimensional tolerances when connecting the buoy to different vessels, whereas the ball joint 59 provides for moment-free transfer of forces from the transfer line 6 to the buoy, and in addition facilitates the positioning of the buoy relative to the receiving space 3, so that the buoy slides easily in place therein. Instead of ball joints other types of flexible joints could be used.

Figure 9:
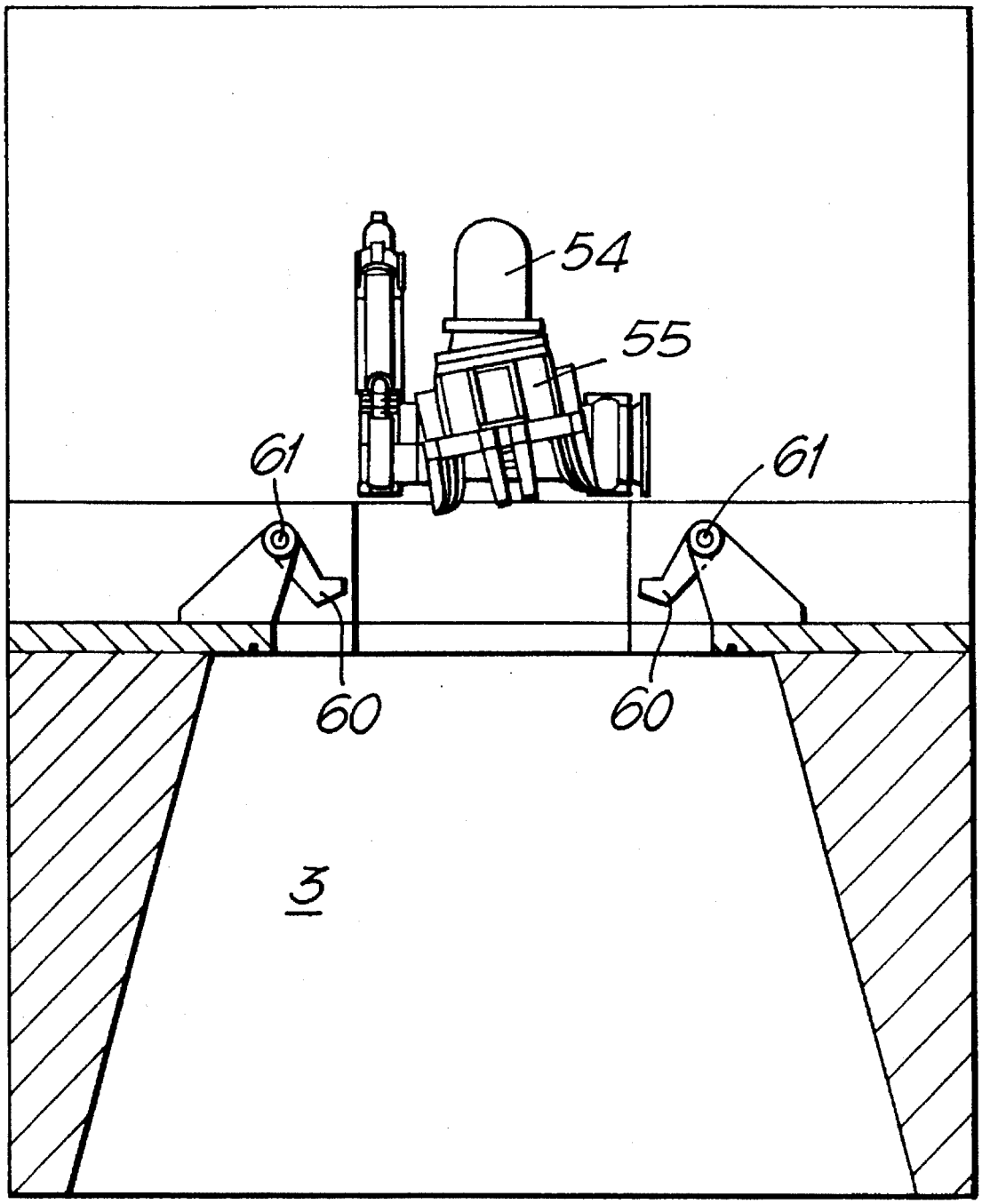
FIG. 9 shows a schematic sectional view of the receiving space in FIG. 8, at right angles to the sectional plane in FIG. 8.

A device for releasable locking of the buoy when it is in place in the receiving space 3, is schematically shown in FIG. 9. In the illustrated embodiment the device consists of a pair of hydraulically actuated locking dogs 60 which are rotatable about horizontal axes 61 on diametrically opposite sides of the receiving space 3, to pivot in a vertical plane between the locking and release positions. The hydraulic actuators for operation of the locking dogs are omitted in the Figure. The locking dogs provide for rigid locking of the outer member 45 of the buoy to the receiving space, and the vessel 1 then is allowed to turn about the central member 46 which is rotatably mounted in the outer member, the swivel means 56 allowing such turning after the coupling tube 54 having been coupled to the buoy.

When the buoy 2 is locked in place in the receiving space 3, an upper abutment surface 62 on the outer member 45 of the buoy is brought into sealing abutment against a sealing flange 63 between the upper and lower parts of the receiving space 3, so that the upper part of the receiving space and the service shaft 9 are shut off from the sea. The receiving space and the shaft then may be emptied of water, for example for inspection and maintenance purposes, the receiving space being connected to a drainage line for this purpose. Such a drainage means 64 is shown in FIG. 4. in FIG. 4, the shaft is also shown to be connected to a line 65 leading to the inert gas and ventilation system of the vessel. Further, there is provided a shutter 66 for shutting off the shaft at the upper end thereof. Thereby the shaft and the receiving space can be filled with inert gas (after removal of the water), as a safety precaution prior to start of transfer of combustible or inflammable medium.

In practice the receiving space 3 and the service shaft 9 will be equipped with suitable sensors and TV cameras for monitoring and control purposes. There will also be arranged pumping equipment for drainage purposes, etc.

The above described method for buoy connection according to the invention may be carried out in a safe manner in relatively rough sea, and it is envisaged that the entire connecting procedure may be carried out in approximately 30 minutes at a wave height of about 3,5–4 meters. Further, the buoy can be released in a very short time and under all weather conditions, since the buoy will fall down and out of the receiving space under its own weight and the mooring forces as soon as the coupling head is released from the central member of the buoy and the locking dogs of the locking device are released from the outer member of the buoy. Thus, the whole release operation can be carried out in a few minutes.

We claim:

1. A method of connecting a buoy to a floating vessel, for transfer of a flowable medium to or from said vessel, said buoy being a submerged loading/unloading buoy anchored to the sea-bed and connected to at least one transfer line for the medium, said method comprising the steps of:

lowering a sink line from said vessel through a downwardly open submerged receiving space in said vessel, said sink line having attached thereto a weight and at least one auxiliary buoy spaced from said weight, allowing the auxiliary buoy to come to the surface, catching said sink line from said vessel, taking up from the vessel a pick-up line connected to said submerged buoy having attached thereto at least one marking means, connecting together said pick-up line and said sink line, and dropping said lines overboard, moving said vessel into position above said submerged buoy, and thereafter pulling up said pick-up and sink lines through said receiving space, whereby said buoy is hoisted up and moved to a locking position therein, and locking said buoy in place in said receiving space.

2. The method of claim 1 wherein said pick-up line is taken up and transferred to said vessel by means of an auxiliary vessel.

3. The method of claim 1 wherein said pick-up line is taken up by means of a catching line which is launched over the pick-up line from said vessel and is thereafter pulled on board said vessel together with the pick-up line.

4. The method of claim 1 wherein said pick-up line is connected to said sink line while said vessel is at a substantial distance from said buoy, and wherein said lines are pulled tight before the vessel is moved into position above said submerged buoy.

5. The method of claim 1 wherein said step of locking said buoy in said receiving space comprises locking said receiving space to an outer member of said buoy, said vessel and said outer member being able to turn about a central member of said buoy, said central member being rotatably mounted in the outer member.

6. A method of connecting a buoy to a floating vessel for transfer of a flowable medium to or from said vessel, said buoy being a submerged loading/unloading buoy anchored to the sea bed and connected to at least one transfer line for said medium, comprising the steps of:

lowering a sink line having a catching means attached thereto from the vessel through a downwardly open submerged receiving spaced in said vessel, catching by means of said catching means a pick-up line connected to said submerged buoy and to at least one marking means, said pick-up line having at least a portion extending essentially horizontally in submerged condition in the sea, moving said vessel into position above said submerged buoy, and thereafter pulling up said sink line and said pick-up line through said receiving space, whereby said buoy is hoisted up and moved to a locking position therein, and locking said buoy in place in said receiving space.

7. The method of claim 6 comprising providing said buoy as an outer member and an inner member, said outer member being rotatable about said inner member, and wherein said step of locking said buoy in said receiving space comprises locking said receiving space to said outer member.

8. A system for transferring a flowable medium between a floating vessel and a submerged transfer line for said medium, said system comprising:

a submerged buoy having said transfer line connected thereto, anchoring means anchoring said buoy to the sea bed, a downwardly open submerged receiving space in said vessel, said receiving space being adapted to receive said buoy therein, hoisting equipment for hoisting said buoy into said receiving space, said hoisting equipment comprising a sink line, a weight attached to said sink line, at least one auxiliary buoy attached to said sink line, and a hoist adapted to lower said sink line, said weight and said at least one auxiliary buoy through said receiving space, a pick-up line connected to said buoy, said pick-up line being adapted for connection to said sink line, at least one marking means attached to said pick-up line, a positioning device on said vessel for bringing said vessel in position above said buoy to permit hoisting of said buoy into said receiving space by said hoisting equipment, and a locking arrangement for locking said buoy in place in said receiving space.

9. The system of claim 8 further comprising a catch device on said vessel for catching said at least one floating auxiliary buoy and for hoisting said at least one floating auxiliary buoy on board said vessel.

10. The system of claim 8 further comprising a launching device on said vessel for launching a catching line over said pick-up line of said buoy for pulling said pick-up line on board said vessel.

11. The system of claim 8 wherein said buoy and said receiving space have at least partly matching upwardly tapering conical shapes to facilitate movement of the buoy to said locking position in the receiving space, and further comprising a lifting bridle for said buoy, said lifting bridle comprising a plurality of lines forming an upper continuation of said outer conical shape of said buoy to further facilitate said movement of said buoy into said receiving space.

12. The system of claim 8 wherein said buoy comprises a central member and an outer member, said outer member being rotatably mounted on said central member, and said locking arrangement is adapted for releasable locking of said outer member in place in said receiving space, whereby said vessel and said outer member are able to turn about said central member.

13. The system of claim 8 wherein said receiving space is located in the lower part of the bow of said vessel.

14. The system of claim 8 further comprising a service shaft connecting said receiving space to a deck of said vessel, and a shutter at the lower end of said service shaft for shutting-off said shaft from the sea when said receiving space is not in use.

15. A system for transferring a flowable medium between a floating vessel and a submerged transfer line for said medium, said system comprising:

a submerged buoy having said transfer line connected thereto, anchoring means anchoring said buoy to the sea bed, a downwardly open submerged receiving space in said vessel, said receiving space being adapted to receive said buoy therein, hoisting equipment for hoisting said buoy into said receiving space, said hoisting equipment comprising a sink line, a catching element fastened to said sink line, and a hoist for lowering said sink line and said catch element through said receiving space, a pick-up line connected to said buoy, at least a portion of said pick-up line extending essentially horizontally in submerged condition in the sea for being caught by said catching element, at least one marker attached to said pick-up line, a positioning device on said vessel for bringing said vessel into position above said buoy whereby said buoy may be hoisted up into said receiving space by said hoisting equipment, and a locking device for locking said buoy in place in said receiving space.

16. The system of claim 15 wherein said buoy and said receiving space have at least partly matching upwardly tapering conical shapes to facilitate movement of said buoy to said locking position in said receiving space.

17. The system of claim 16 further comprising a lifting bridle for said buoy, said lifting bridle comprising at least two lines forming an upper continuation of the outer conical shape of said buoy to facilitate said movement of said buoy into said receiving space.

18. The system of claim 15 wherein said buoy comprises an outer member, and an inner member rotatably received within said outer member, and wherein said locking device is adapted for releasable locking of said outer member into said receiving space, whereby said vessel and said outer member are able to turn about said inner member.

19. The system of claim 15 wherein said receiving space is located in the lower part of the bow region of said vessel.

20. The system of claim 15 further comprising a service shaft communicating said receiving space with the deck of said vessel, and a shutter at the lower end of said shaft for shutting-off said shaft from the sea when said receiving space is not in use.

* * * * *

UNITED STATES PATENT AND TRADEMARK OFFICE

CERTIFICATE OF CORRECTION

PATENT NO. : 5,456,622

DATED : October 10, 1995

INVENTOR(S) : Kare Breivik, Harald Kleppesto & Arne Smedal

It is certified that error appears in the above-indentified patent and that said Letters Patent is hereby corrected as shown below:

On the title page: Item

[73] Assignee: Den Norske Stats Oleselskap A.S.

should read

[73] Assignee: Den Norske Stats Oljeselskap AS

Signed and Sealed this

Twelfth Day of November, 1996

*Attest:*

*Attesting Officer*

Bruce Lehman

BRUCE LEHMAN

*Commissioner of Patents and Trademarks*